US005545020A

United States Patent [19]

Fukanuma et al.

[11] Patent Number: 5,545,020

[45] Date of Patent: Aug. 13, 1996

[54] SCROLL TYPE COMPRESSOR WITH SPIRAL SEALS

[75] Inventors: Tetsuhiko Fukanuma; Kunifumi Goto; Shinya Yamamoto; Masao Iguchi, all of Kariya, Japan

[73] Assignee: Kabushiki Kaisha Toyoda Jidoshokki Seisakusho, Kariya, Japan

[21] Appl. No.: 433,497

[22] PCT Filed: Aug. 31, 1994

[86] PCT No.: PCT/JP94/01438

§ 371 Date: May 1, 1995

§ 102(e) Date: May 1, 1995

[87] PCT Pub. No.: WO95/06820

PCT Pub. Date: Mar. 9, 1995

[30] Foreign Application Priority Data

Sep. 2, 1993 [JP] Japan ..... 5-218860

[51] Int. Cl.[6] ..... F01C 1/04

[52] U.S. Cl. ..... 418/55.4; 418/55.2; 418/55.3

[58] Field of Search ..... 418/55.2, 55.3, 418/55.4, 55.5, 142

[56] References Cited

U.S. PATENT DOCUMENTS

| | | | |
|---|---|---|---|
| 4,548,555 | 10/1985 | Hiraga et al. | 418/55.2 |
| 4,655,697 | 4/1987 | Nakamura et al. | 418/55.4 |
| 5,192,202 | 3/1993 | Lee | 418/55.5 |

FOREIGN PATENT DOCUMENTS

| | | | |
|---|---|---|---|
| 9114189 | 9/1984 | Japan . | |
| 1265304 | 11/1986 | Japan . | |
| 2223488 | 10/1987 | Japan . | |
| 361685 | 3/1991 | Japan . | |
| 124983 | 5/1991 | Japan | 418/55.4 |

*Primary Examiner*—Charles Freay

*Attorney, Agent, or Firm*—Brooks Haidt Haffner & Delahunty

[57] ABSTRACT

A compressor has a fixed scroll (2) and a movable scroll (9). Both scrolls (2), (9) have end plates (11), (13) and spiral elements (12), (14) integrated with their end plates (11), (13). Both scrolls (2), (9) engage with each other at the spiral elements (12), (14). Pockets (16–19) are formed between both spiral elements (12), (14). The pockets (16–19) move toward the centers of the spiral elements (12), (14) while their volumes are reduced in accordance with the revolution of the movable scroll (9), thus compressing refrigerant gas. Grooves (52), (50) are formed in end faces of the spiral elements (12), (14) of both the fixed and movable scrolls (2), (9). Fitted in those grooves (52), (50) are seals (53), (51) for securing airtightness with the mating end plates (12), (14). A height of at least one seal (53), (51) from the end face of the spiral element (12), (14) is set to a value for preventing peripheral end faces of the spiral elements (12), (14) from contacting the end plates (13), (11) of the mating scrolls (9), (8), with the movable scroll (9) inclined based on an assembling tolerance between the fixed scroll (2) and the movable scroll (9).

30 Claims, 10 Drawing Sheets

SCROLL TYPE COMPRESSOR WITH SPIRAL SEALS

TECHNICAL FIELD

The present invention relates to a scroll type compressor for use in an air conditioning system for a vehicle, for example.

BACKGROUND ART

A conventional scroll-type compressor disclosed in Japanese Unexamined Utility Model Publication No. 58-8783 is illustrated in FIGS. 10 and 11. This scroll-type compressor includes a fixed scroll 102 having a spiral element 101 integrated with an end plate 100, and a movable scroll 105 having a spiral element 104 integrated with an end plate 103. The fixed scroll 102 and movable scroll 105 engage with each other at the spiral elements 101 and 104.

As the movable scroll 105 revolves around its own axis at a given radius, pockets 106 to 109 between both spiral elements 101 and 104 are shifted toward the spiral centers of the spiral elements 101 and 104 while reducing their volumes. This movement causes the refrigerant gases in the pockets 106–109 to be compressed.

Grooves 110 and 111 are formed in the end faces of the spiral elements 101 and 104 of the fixed and movable scrolls 102 and 105. Seals 112 and 113 are fitted in both grooves 110 and 111 to secure the sealing with the end plate 100, 103 of the mating scroll 102, 105. The grooves 110 and ill are formed about the spiral centers of the spiral elements 101 and 104 in a range of nearly 540 degrees. Therefore, the seals 112 and 113 have lengths matching with the range of 540 degrees about the spiral centers of the spiral elements 101 and 104, and are not present outside the range.

The reason is as follows. The gas pressures in the pockets 108 and 109 located close to the centers of both scrolls 102 and 105 are high, and the gas pressures in the pockets 106 and 107 on the peripheral sides do not become so high. Therefore, it is unnecessary to improve the sealing performance on the peripheral sides of the spiral elements 101 and 104, eliminating the need for the seals 112 and 113.

As mentioned above, since the gas pressures in the pockets 106 and 107 on the peripheral sides do not become high, it is desirable that the peripheral portions of the spiral elements 101 and 104 be thinner in order to make the compressor lighter. When the peripheral portions of the spiral elements 101 and 104 are made thin, the seals 112 and 113 cannot be provided at those thin portions. Further, if the grooves 110 and 111 and the seals 112 and 113 are short, processing of the grooves 110 and 111 becomes easier and a less amount of materials be needed for the seals 112 and 113, thus reducing the manufacturing cost.

Generally speaking, a scroll type compressor has a dimensional tolerance between the fixed scroll and movable scroll. In other words, there is a clearance in the axial direction between both scrolls.

At the time the movable scroll 105 revolves, the movable scroll 105 may slightly tilt as shown in FIG. 11, for example, due to variations in various forces acting on the movable scroll 105. This inclination of the movable scroll 105 causes the corner portions of the peripheral end faces of the spiral elements 101, 104 of the fixed and movable scrolls 102, 105 where the seals 112, 113 are not present to contact the end plates 100, 103 of the matching scrolls 102, 105. This contact may cause power loss, vibration or noise, or may damage the end faces of the spiral elements 101, 104 and the end plates 100, 103 when driving the compressor.

To prevent the end plates 100, 103 from being damaged, a process has been adopted for adhering thin steel plates to the inner surfaces of the end plates 100, 103. This of course increases the number of parts. What is more, while damage to the end plates 100, 103 can be prevented, it is not possible to prevent vibration and noise or prevent damages to the spiral elements 101, 104.

DISCLOSURE OF THE INVENTION

It is an objective of the present invention to provide a scroll type compressor, which prevents the spiral elements of both the fixed and movable scrolls from contacting the end plates of the mating scrolls when the movable scroll is inclined, thus preventing the scrolls from being damaged and suppressing vibration and noise without increasing the number of parts of the compressor.

It is another objective of this invention to provide a scroll type compressor which can enhance the sealing property of the seals to improve the compression efficiency and improve the durability of the seals.

To overcome the aforementioned problems and other problems in accordance with the objectives of this invention, an improved scroll type compressor is provided. This scroll type compressor has a fixed scroll and a movable scroll. Both scrolls have end plates and spiral elements integrated with their end plates. Both scrolls engage with each other at the spiral elements. Pockets are formed between both spiral elements. The pockets move toward the centers of the spiral elements while their volumes are reduced in accordance with the revolution of the movable scroll, thus compressing refrigerant gas. Grooves are formed in end faces of the spiral elements of both the fixed and movable scrolls. Fitted in those grooves are seals for securing airtightness with the mating end plates. A height of at least one seal from the end face of the spiral element is set to a value for preventing peripheral end faces of the spiral elements from contacting the end plates of the mating scrolls, with the movable scroll inclined based on an assembling tolerance between the fixed scroll and the movable scroll.

The seals are formed of a synthetic resin material containing an abrasive resistant material, such as carbon fiber or glass fiber.

BRIEF DESCRIPTION OF THE DRAWINGS

FIG. 1 is a general cross-sectional view of a scroll type compressor.

FIG. 2 is an exploded perspective view showing a ring and a movable scroll.

FIG. 3 is an exploded perspective view showing a seal and the movable scroll.

FIG. 4 is a cross-sectional view illustrating the engagement of a fixed scroll with the movable scroll.

FIG. 5 is an enlarged cross-sectional view showing a structure for preventing contact between the movable scroll and fixed scroll.

FIG. 6 is an enlarged cross-sectional view showing clearances between the spiral element and seal of the movable scroll and the end plate of the fixed scroll.

FIG. 7 is an enlarged cross-sectional view showing clearances between the spiral element and seal of the fixed scroll and the end plate of the movable scroll.

FIG. 8 is a general cross-sectional view of a scroll type compressor.

FIG. 9 is an exploded perspective view mainly showing a housing, a ring and a movable scroll.

FIG. 10 is a cross-sectional view illustrating the engagement of a fixed scroll with a movable scroll.

FIG. 11 is a cross-sectional view showing the movable scroll in the inclined state.

BEST MODE OF CARRYING OUT THE INVENTION

One embodiment of this invention will now be described referring to FIGS. 1 through 7.

Figure 1:
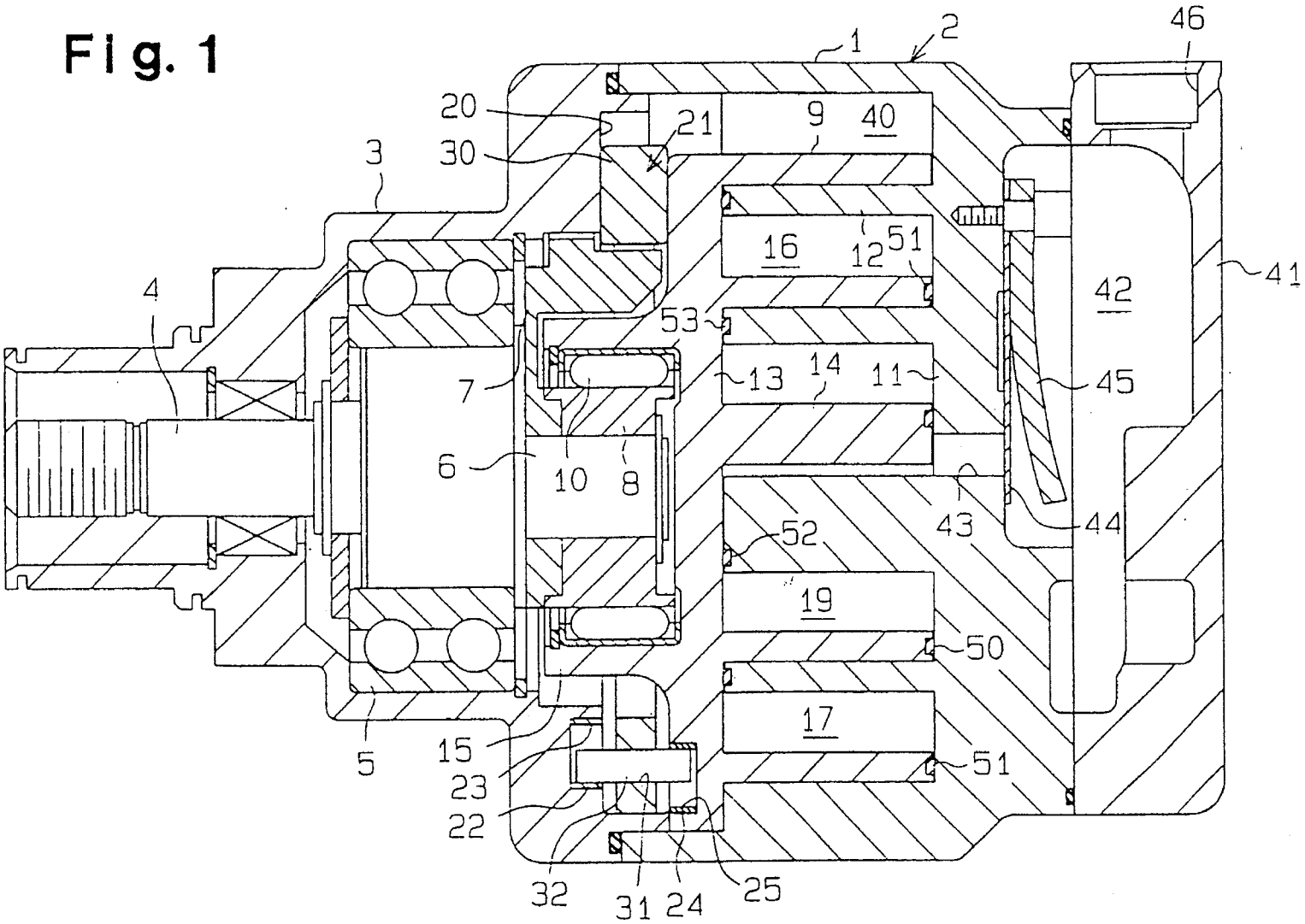
FIGS. 1 through 7 illustrate a first embodiment of this invention.

As shown in FIG. 1, fixed to a fixed scroll 2 of aluminum alloy having a center housing 1 is a front housing 3 also of aluminum alloy. A drive shaft 4 is rotatably supported in the front housing 3 via a radial bearing 5. An eccentric shaft 6 is secured to the drive shaft 4. A counter weight 7 and bushing 8 are relatively rotatably supported on the eccentric shaft 6. A movable scroll 9 of aluminum alloy is relatively rotatably supported on the bushing 8 at its boss 15 via a radial bearing 10 so as to face the fixed scroll 2.

The fixed scroll 2 comprises an end plate 11, a spiral element 12 integrated with the end plate 11, and the center housing 1, which is also integrated with the end plate 11. The movable scroll 9 comprises an end plate 13, a spiral element 14 integrated with the end plate 13 and the boss 15 also integrated with the end plate 13.

Figure 4:
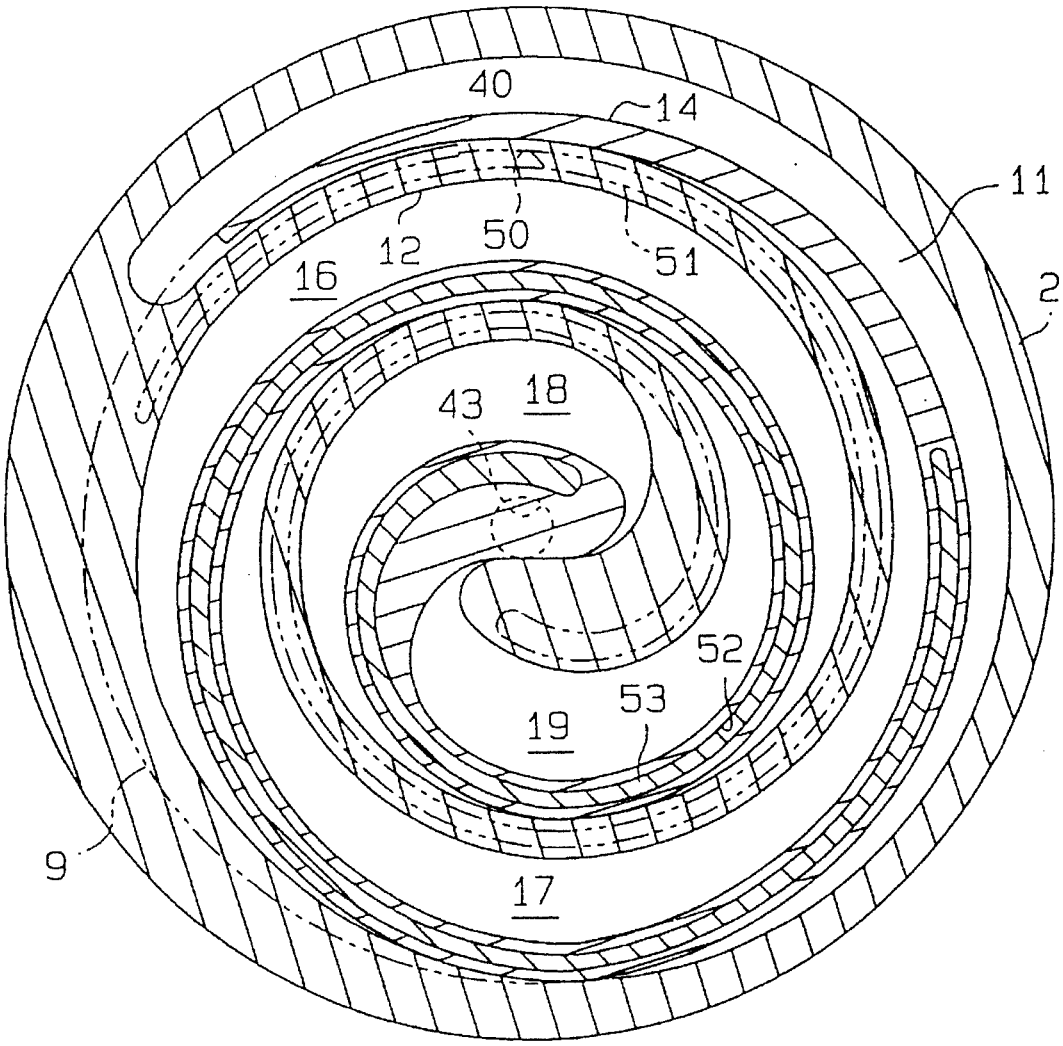

As shown in FIGS. 1 and 4, the fixed scroll 2 and the movable scroll 9 engage with each other at the spiral elements 12 and 14, with a plurality of pockets 16 to 19 formed between both spiral elements 12 and 14 as shown in FIG. 4.

As the drive shaft rotates, the eccentric shaft 6 revolves around the axis of the drive shaft 4 at a given radius. As the drive shaft rotates, therefore, the movable scroll 9 revolves around the axis of the drive shaft 4 at a given radius. This revolution causes the pockets 16 to 19 to shift toward the spiral centers of the spiral elements 12 and 14 while reducing the volumes, whereby the refrigerant gas in the pockets 16–19 is compressed.

Figure 2:
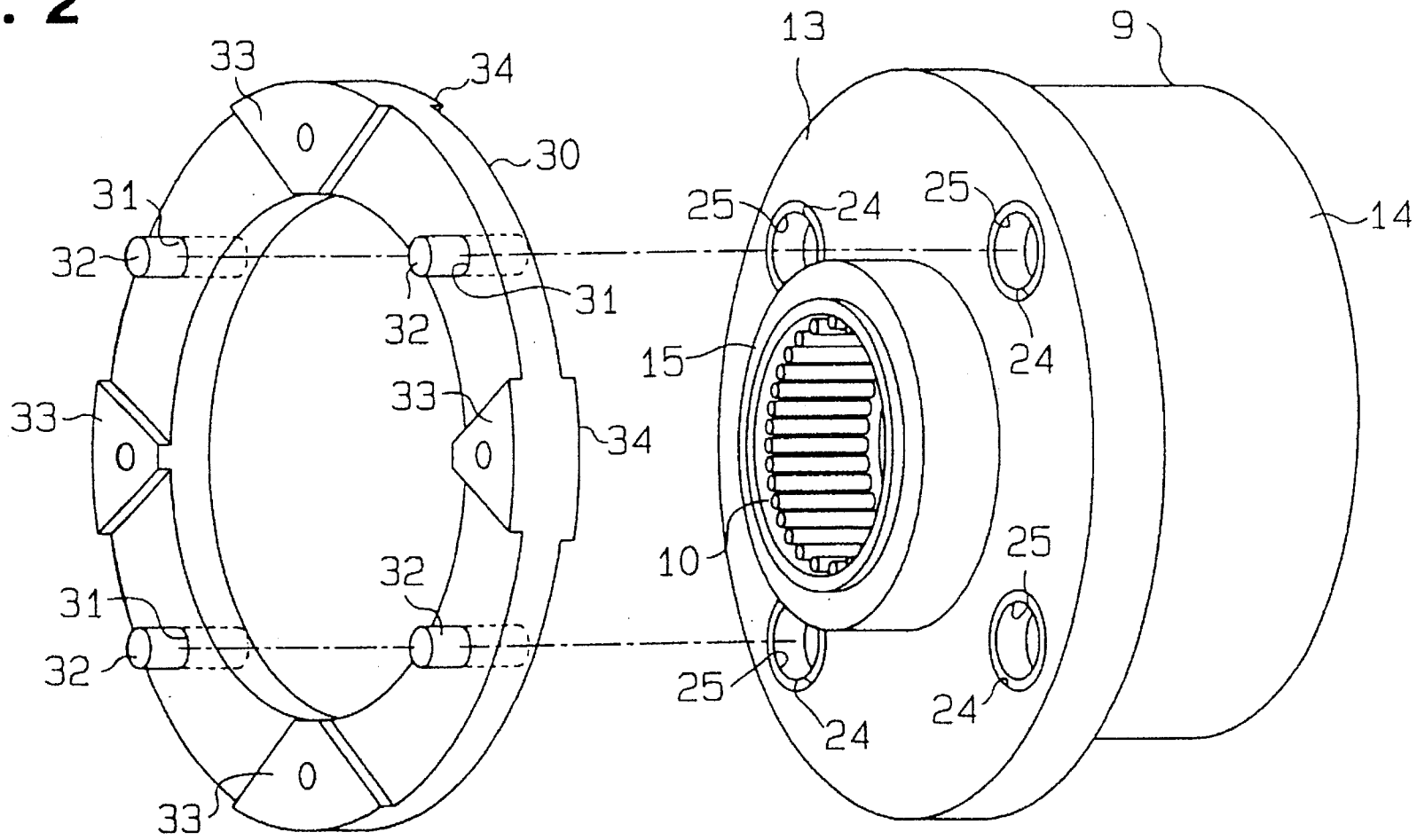
Figure 3:
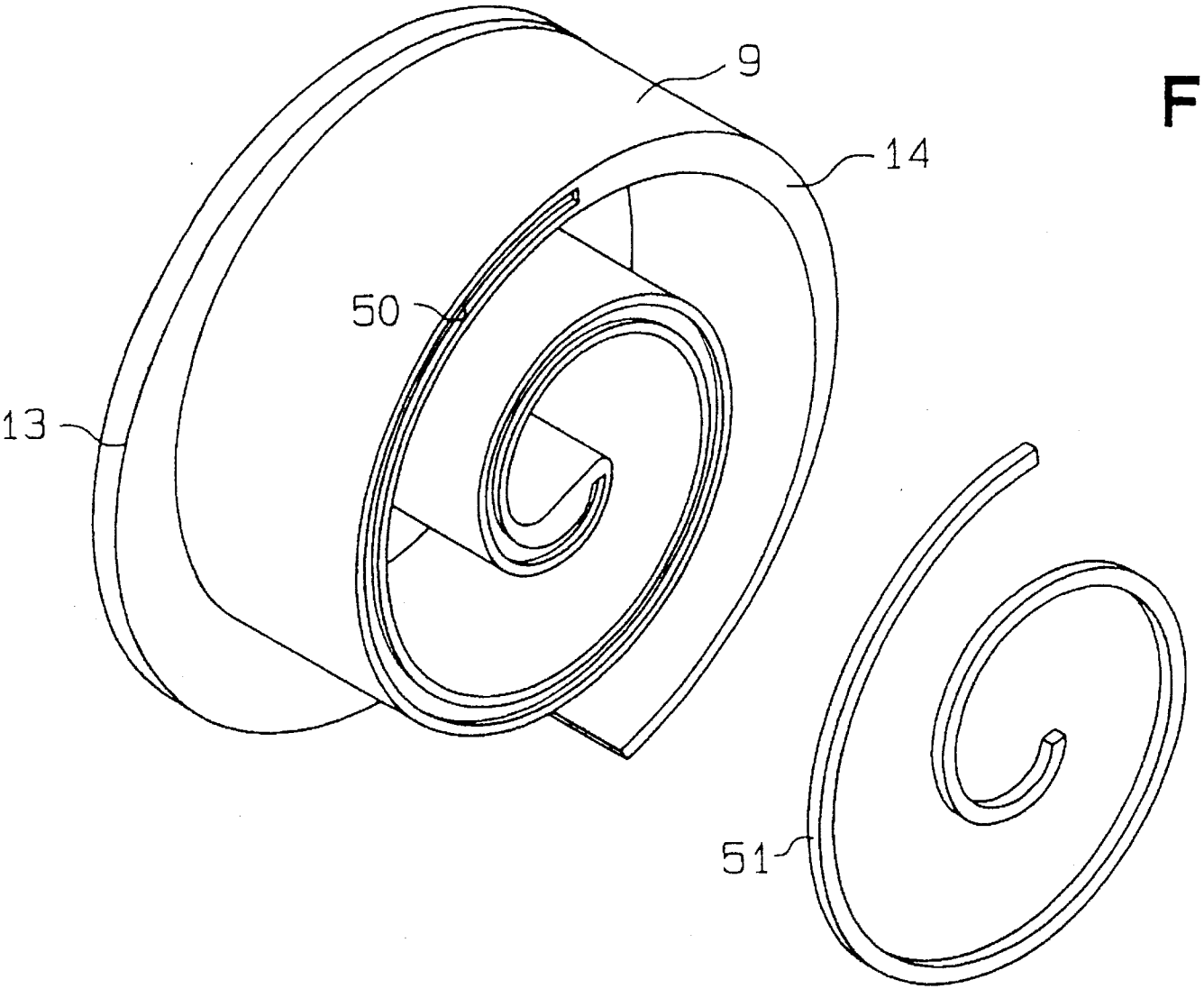

As shown in FIGS. 1 and 2, a single pressure receiving ring 30 intervenes between a wall 20 of the front housing 3 and the end plate 13 of the movable scroll 9. Projections 34 contacting the end plate 13 of the movable scroll 9 and projections 33 contacting the wall 20 of the front housing 3 are formed at four locations of the pressure receiving ring 30. As the gas is compressed, the compressive reactive force acts on the movable scroll 9 in the axial direction. This compressive reactive force is received at the wall 20 via the projections 33 and 34. The portions between the projections 33 and 34 of the ring 30 are made thin, and the gas containing oil passes the thin portions. Accordingly, the radial bearing 10, etc. are lubricated by the oil.

A rotation preventing device 21, which prevents the rotation of the movable scroll 9 around its axis and permits the aforementioned revolution, intervenes between the end plate 13 of the movable scroll 9 and the wall 20 of the front housing 3. This device 21 has a plurality of collars 23 (four in this embodiment, but only one shown) fitted in holes 22 of the wall 20, and a plurality of collars 25 fitted in holes 24 of the end plate 13 of the movable scroll 9.

A plurality of holes 31 are formed in the ring 30 (at four locations in this embodiment). Pins 32 are inserted in the respective holes 31 to be secured to the ring 30. Those pins 32 are loosely inserted in the respective collars 23 and 25. The engagement of the pins 32 with the collars 23, 25 prevents the rotation of the movable scroll 9.

An inlet port (not shown) is formed in the front housing 3. A suction chamber 40 is formed in the center housing 1 in such a way as to surround both spiral elements 12 and 14. Gas is supplied to the pockets 16–19 from the inlet port via the suction chamber 40.

A rear housing 41 is secured to the fixed scroll 2. A discharge chamber 42 is formed between the fixed scroll 2 and the rear housing 41. A port 43 for conveying the gas compressed in the pockets 16–19 is formed in the end plate 11 of the fixed scroll 2, and a reed valve 44 is provided at the end plate 11 in the discharge chamber 42. A retainer 45 prevents over-opening of the reed valve 44. A discharge port 46 for supplying gas in the discharge chamber 42 to an unillustrated external refrigeration circuit is formed in the rear housing 41.

The center housing 1, front housing 3 and rear housing 41 constitute the housing of this compressor.

As shown in FIGS. 1, 3, 4 and 5, a groove 50 is formed in the end face of the spiral element 14 of the movable scroll 9, in the direction of the extension of the spiral element 14 from the center of the spiral element 14. The groove 50 is formed in a range of nearly 560 degrees from the spiral center of the spiral element 14. A spiral seal 51 for securing airtightness is fitted in the groove 50. Therefore, the seal 51 has a length over nearly 560 degrees. A groove 52 is formed in the end face of the spiral element 12 of the fixed scroll 2, in the direction of the extension of the spiral element 12 from the spiral center of the spiral element 12 in a range of nearly 540 degrees, and a seal 53 like the seal 51 is fitted in that groove 52.

A synthetic resin material containing short fibers of an abrasive resistant material, such as carbon fiber or glass fiber, is used for those seals 51 and 53. Accordingly, the seals 51 and 53 have a certain degree of rigidity with improved sealing property and have an excellent durability and abrasive resistance.

Figure 5:
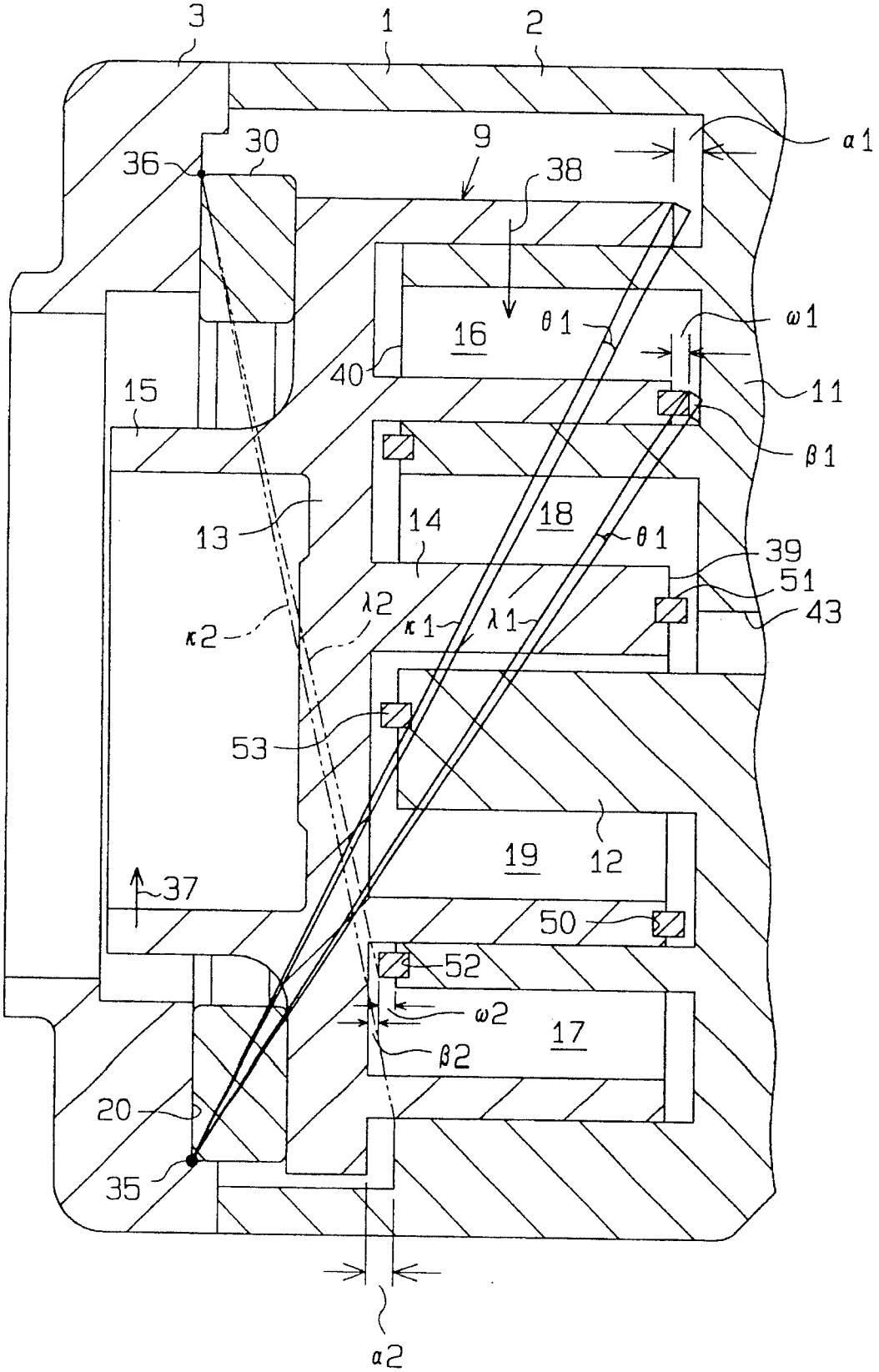
Figure 6:
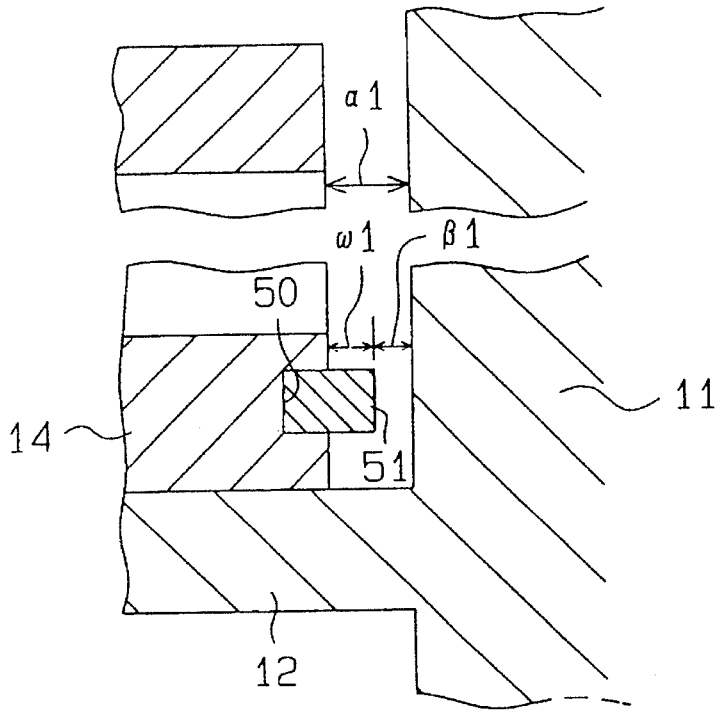
Figure 7:
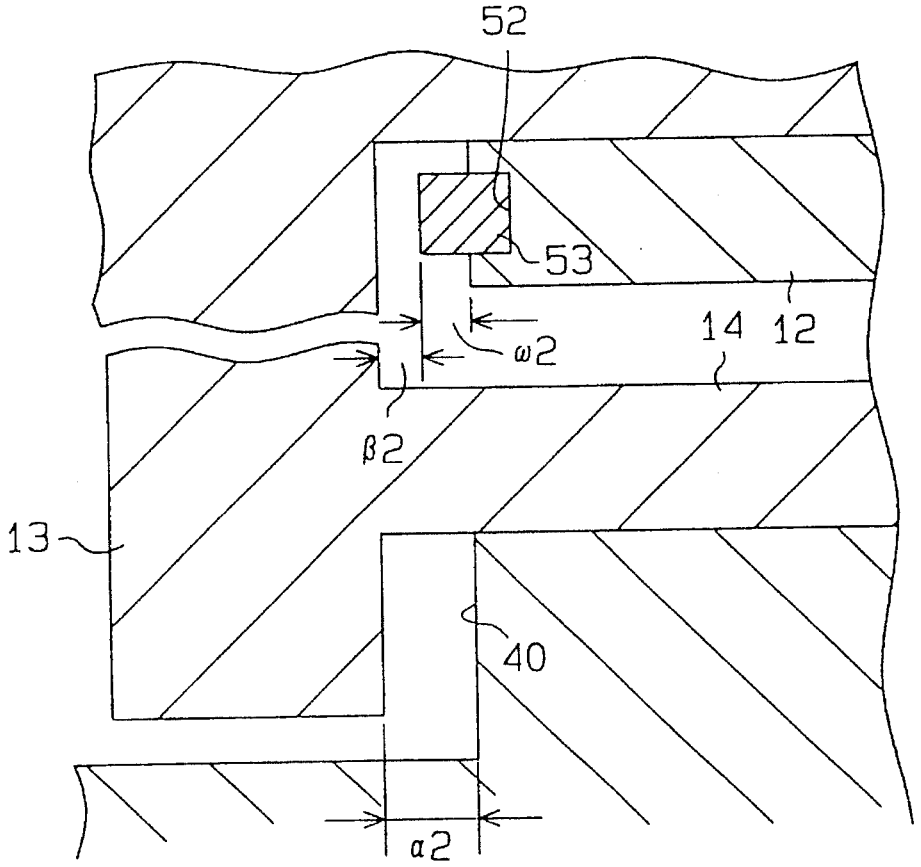

As shown in FIGS. 5, 6 and 7, a dimensional tolerance or clearance $\alpha 1$ is set between the end face of the spiral element 14 of the movable scroll 9 and the end plate 11 of the fixed scroll 2. A dimensional tolerance or clearance $\beta 1$ is formed between the seal 51 of the movable scroll 9 and the end plate 11 of the fixed scroll 2. A dimensional tolerance or clearance $\alpha 2$ is set between the end face of the spiral element 12 of the fixed scroll 2 and the end plate 13 of the movable scroll 9. A dimensional tolerance or clearance $\beta 2$ is likewise formed between the seal 53 of the fixed scroll 2 and the end plate 13 of the movable scroll.

The clearances $\alpha 1$ and $\alpha 2$ are actually about 4/100 to 1/10 mm. The clearances $\beta 1$ and $\beta 2$ are actually about 5/100 to 1/10 mm. The heights, $\omega 1$ and $\omega 2$, of both seals 51 and 53 from the spiral elements 12 and 14 are about 1/100 to 4/100 mm.

As the drive shaft 4 is rotated by the rotation of the engine (not shown), the eccentric shaft 6 causes the movable scroll 9 to revolve. The revolution of the movable scroll 9 causes the pockets 16–19 to shift toward the spiral center while their volumes are reduced, thus compressing the gases in the pockets 16–19. The compressed gas flows out of the port 42, opens the reed valve 44, flows into the discharge chamber 42, and is sent to the external refrigeration circuit (not shown) via the discharge port 46.

The compressive reactive force on the scroll 9 acts to incline the movable scroll 9 with respect to the axis of the shaft 4 during its revolution. In this embodiment, even when the movable scroll 9 is inclined, the heights $\omega 1$ and $\omega 2$ of the seals 51 and 53 are set such that the spiral elements 12 and 14 of both scrolls 2 and 9 do not contact the end plates 13 and 11 of the mating scrolls 9 and 2. In other words, when the movable scroll 9 is inclined, the seals 51 and 53 prevent the spiral elements 12 and 14 from contacting the end plates 11 and 13.

For example, the driving force of the eccentric shaft 6 acts on the boss 15 of the movable scroll 9 in the direction of an arrow 37, and the compressive reactive force acts on the spiral element 14 of the movable scroll 9 in the direction of an arrow 38, thereby imparting an inclining force to the movable scroll 9. As the ring 30 is simply sandwiched between the movable scroll 9 and the wall 20, an inclining force in the same direction as that to the movable scroll 9 is also given to the ring 30 about a contact point 35 between the corner of the projection 33 and the wall 20. Therefore, the movable scroll 9 tilts around the contact point 35. The amount of inclination of the movable scroll 9 is the greatest when the center of contact between the ring 21 and the wall 20 is the point 35.

At this time, if the seal 51 of the movable scroll 9 is formed low in the tolerance range and the seal 53 of the fixed scroll 2 is formed low in the tolerance range, the peripheral portions of the spiral elements 12 and 14 of both scrolls 2 and 9, i.e., the corners of the end faces of the portions where the seals 51 and 53 are not present, may contact the end plates 11 and 13 of the opposing scrolls 2 and 9.

In order to prevent it, the heights $\omega l$ and $\omega 2$ of the seals 51 and 53 from the end faces of the spiral elements 14 and 12 are set as follows. First, the height of the seal 51 of the movable scroll 9 is set as follows.

Given that the inclination angle of the movable scroll 9 is $\theta 1$, the following conditions of equations (1) and (2) are satisfied.

$$\alpha 1>\kappa 1\cdot\theta 1>\lambda 1\cdot\theta 1\cdot\theta 1>\beta 1 \quad (1)$$

where $\kappa 1$ is the radius of the inclination of the peripheral portion of the spiral element 14 to the end face about the contact point 35, and $\lambda 1$ is the radius of the inclination of the peripheral portion of the seal 51 to the end face about the contact point 35. It should be noted that $$\theta<0.1 \text{ degree}$$

$$\alpha 1=\beta 1+\omega 1 \quad (2)$$

and $$\beta 1<\alpha 1(\lambda 1/\kappa 1) \quad (3)$$

From the equation (2), $$\beta 1=\alpha 1-\omega 1 \quad (4)$$

so that the equations (3) and (4 ) yield $$\alpha 1-\omega 1<\alpha 1(\lambda 1/\kappa 1) \quad (5)$$

Thus, the height $\omega 1$ of the seal 51 is set so that the following equation (6) is satisfied.

$$\alpha 1>\omega 1>\alpha 1\{1-(\lambda 1/\kappa 1)\} \quad (6)$$

Likewise, the height $\omega 2$ of the seal 53 of the fixed scroll 2 is set so that the following equation (7) is satisfied.

$$\alpha 2>\omega 2>\alpha 2\{1-(\lambda 2/\kappa 2)\} \quad (7)$$

where $\kappa K2$ is the radius of the inclination of the peripheral portion of the spiral element 12 to the end face about a contact point 36, and $\lambda 2$ is the radius of the inclination of the peripheral portion of the seal 53 to the end face about the contact point 36.

According to this first embodiment, as described above, due to the dimensional tolerances or clearances $\alpha 1$, $\beta 1$, $\alpha 2$ and $\beta 2$ between the movable scroll 9 and the fixed scroll 2, the movable scroll 9 may slightly tilt as mentioned above. Since the heights $\omega l$ and $\omega 2$ of the seals 51 and 53 are set such that the equations (6) and (7) are satisfied, the end faces of the spiral elements 12 and 14 do not contact the end plates 13 and 11 of the mating movable and fixed scrolls 9 and 2.

This eliminates power loss in driving the compressor, prevents the fixed and movable scrolls 2 and 9 from being damaged and can suppress the occurrence of noise and vibration. In addition, since the heights $\omega 1$ and $\omega 2$ of the seals 51 and 53 are merely set in given ranges to obtain the above advantages, the number of parts does not increase.

Incidentally, the spiral center sides of the seals 51 and 53 hardly contribute to the prevention of the contact between the spiral elements 12 and 14 and the end plates 11 and 13. Therefore, the equations (6) and (7) should not necessarily be satisfied for the spiral center portions of the seals 51 and 53, and the tolerances alone should be met. Of course, the equations (6) and (7) may be satisfied for the entire portions of the seals 51, 53 from the periphery to the center.

Figure 8:
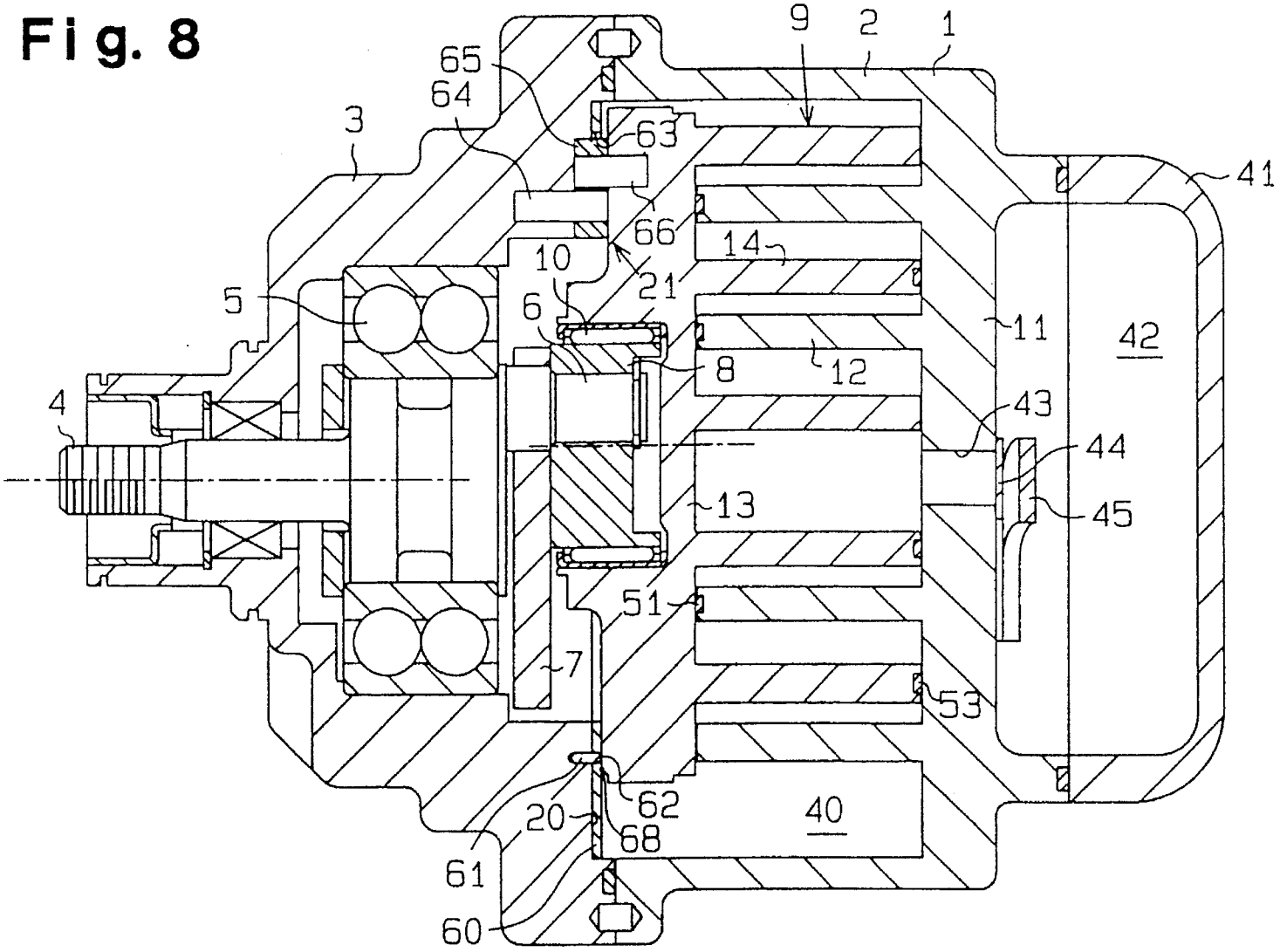
FIGS. 8 and 9 illustrate a second embodiment of this invention.
Figure 9:
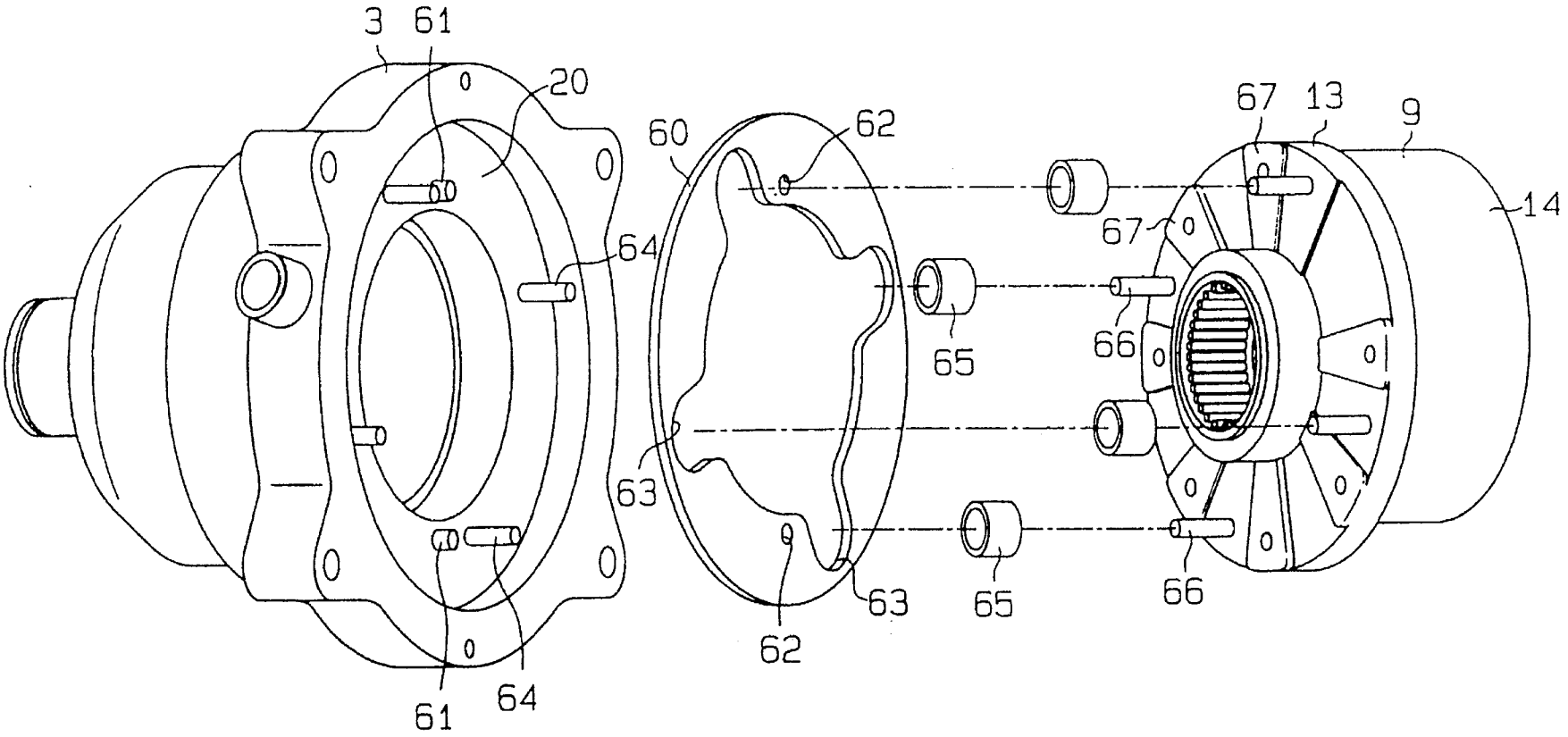
Figure 10:
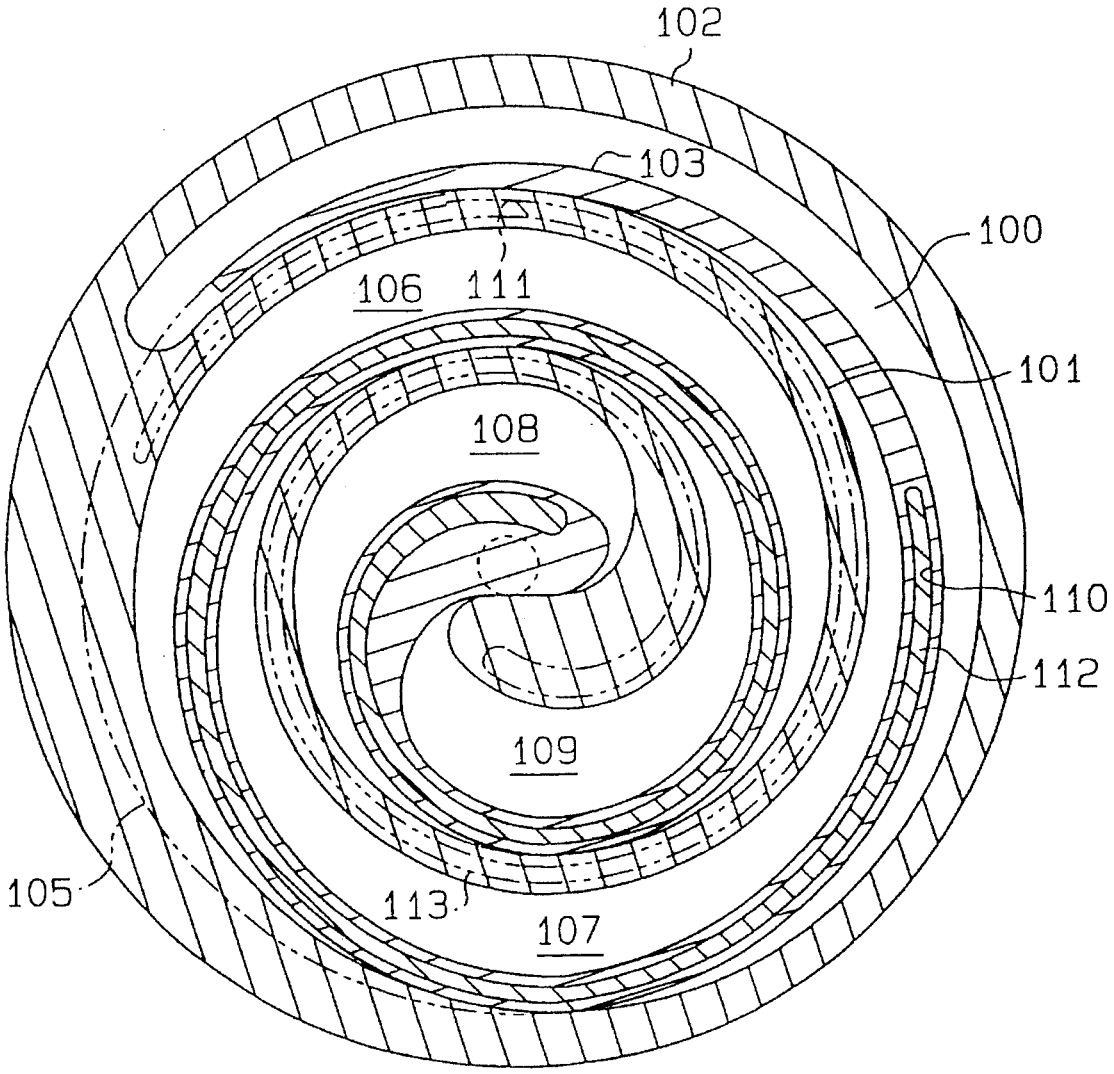
Fig. 10 (Prior Art)
FIGS. 10 and 11 illustrate prior art.
Figure 11:
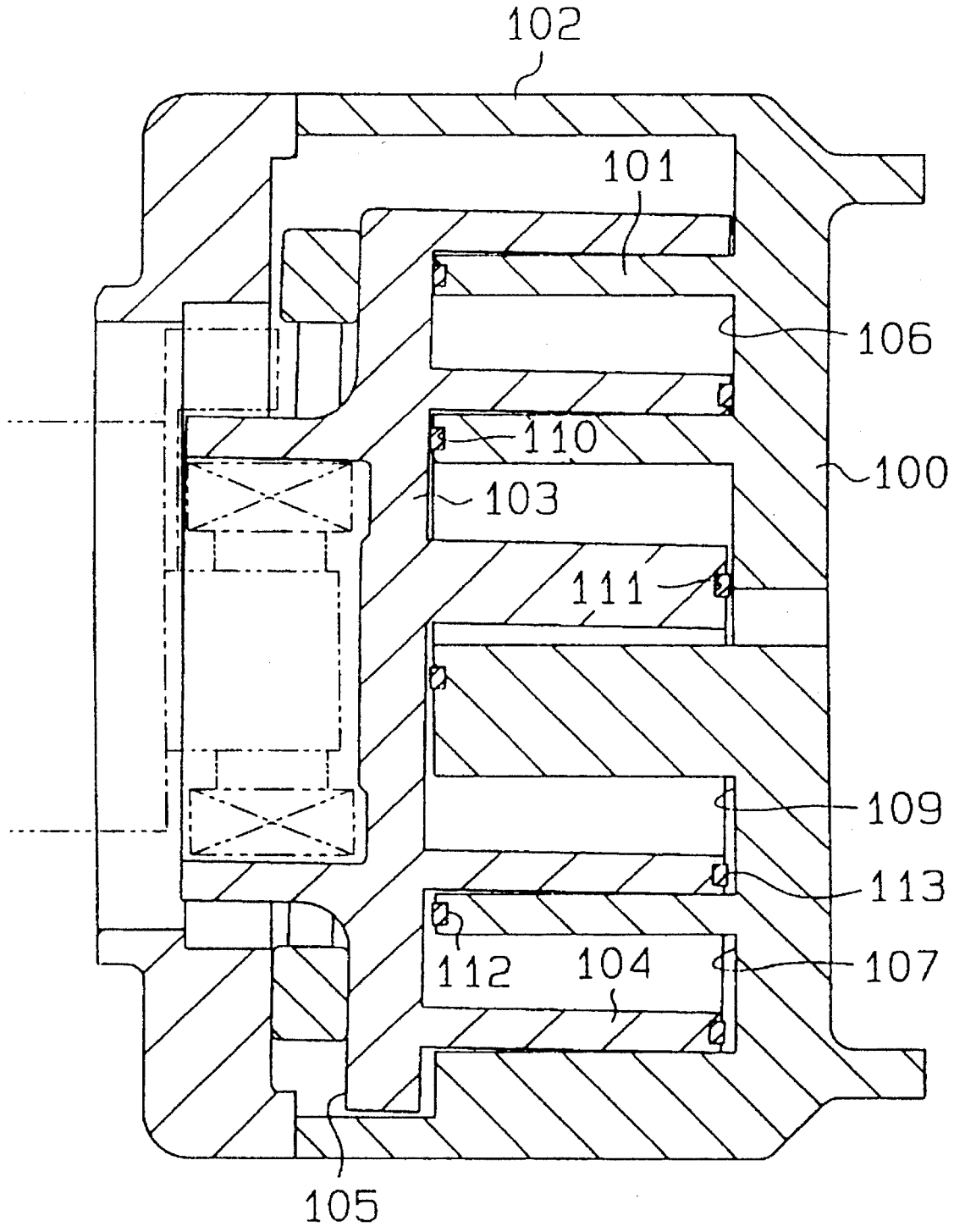
Fig. 11 (Prior Art)

FIGS. 8 and 9 illustrate a second embodiment of this invention.

The second embodiment differs from the first embodiment in the structure for preventing the rotation of the movable scroll 9 and is not provided with the ring 30.

A ring-shaped plate 60 is provided at the wall 20 of the front housing 3. As fixed pins 61 fixed to the wall 20 are fitted in holes 62 in the plate 60, the plate 60 is secured. This plate 60 constitutes a part of the wall 20 of the front housing 3. The movable scroll 9 contacts the plate 60 at a projection 67 of the end plate 13. As the movable scroll 9 revolves, therefore, it slides on the plate 60 which is a part of the wall 20. The compressive reactive force at the time of gas compression is received at the wall 20.

Recesses 63 are formed in the inner surface of the plate 60 at four locations at equal intervals. First pins 64 are fixed to the wall 20 so as to be positioned in the recesses 63. A total of four rings 65 are arranged in the respective recesses 63, and the first pins 64 are loosely inserted in the rings 65. Second pins 66' are secured to the end plate 13 of the movable scroll 9, and are loosely inserted in the rings 65.

The rings 65 and the first and second pins 64 and 66 prevent the rotation of the movable scroll 105. Accordingly, as the drive shaft 4 rotates, the movable scroll 9 revolves for gas compression together with the revolution of the rings 65.

In the second embodiment, the movable scroll 9 is inclined about a contact point 68 between the plate 60 and the corner of the end plate 13 of the movable scroll 9. In this second embodiment, the heights of the seals 51 and 53 are also set to values for preventing the spiral elements 12 and 14 from contacting the end plates 11 and 13 of the mating scrolls 2 and 9. Further, the structure expressed by the equations (6) and (7) is also employed in the second embodiment. In this case, the center of inclination of the movable scroll 9 lies between the corner of the end plate 13 of the movable scroll 9 and the wall 20.

In the second embodiment, therefore, the contact between the peripheral end faces of the spiral elements 12 and 14 and the end plates 11 and 13 is prevented without increasing the number of parts, making it possible to prevent power loss, damage to the fixed and movable scrolls 2 and 9 and to suppress vibration and noise.

Although the heights of seals 53 and 51 of the fixed and movable scrolls 2 and 9 are set to $\omega 2$ and $\omega 1$ which prevent the spiral elements 12 and 14 from contacting the end plates 11 and 13 in the first and second embodiments, even employing only one of the seals 53 and 51 can contribute to preventing the spiral elements 12 and 14 from contacting the end plates 11 and 13. In this case, since it is the movable scroll 9 which is inclined, this invention should embody the seal 51 of the movable scroll 9.

We claim:

1. A scroll type compressor comprising a fixed scroll in a housing and a movable scroll opposed to the fixed scroll to define a compression chamber with the fixed scroll, said fixed scroll having a fixed spiral element with an adjacent integral fixed end plate and a fixed spiral end face, said movable scroll having a movable spiral element with an adjacent integral movable end plate and a movable spiral end face, a drive shaft, said movable scroll being mounted for orbital motion about an axis of said drive shaft with said fixed and movable scrolls defining between their respective spiral elements a plurality of pockets that decrease in volume with the orbital motion of said movable scroll to compress any gas within the pockets with accompanying development of reaction force acting upon the scrolls, said end face of each spiral element facing the end plate of the opposite scroll with a clearance space therebetween, each of said spiral elements extending from a respective radially inner termination to a respective radially outer termination, a first spiral seal mounted on said movable spiral end face extending from near said radially inner termination of said movable spiral element to an intermediate point along said movable spiral element and constructed to bridge said clearance space between said movable spiral end face and said fixed end plate, and a second spiral seal mounted on said fixed spiral end face extending from near said radially inner termination of said fixed spiral element to an intermediate point along said fixed spiral element and constructed to bridge said clearance space between said fixed spiral end face and said movable end plate, the mounting of said movable scroll permitting said movable scroll to incline relative to said fixed scroll, said first seal having a height ($\omega 1$) which is defined by a first formula:

$$\alpha 1>\omega 1>\alpha 1\{1-(\lambda 1/\kappa 1)\}$$

where $\alpha 1$ represents the clearance defined between said movable spiral end face and said fixed end plate, where $\lambda 1$ is the radius of an arc locus of the rotational movement of a tip of said first spiral seal about a first point that supports said movable scroll when said movable scroll is inclined relative to said shaft, and where $\kappa 1$ is the radius of an arc locus of the rotational movement of a tip of said movable spiral element about said first point.

2. The scroll type compressor as set forth in claim 1, wherein said movable spiral end face has a first spiral groove and said fixed spiral end face has a second spiral groove, and wherein said first spiral seal is fitted in said first spiral groove and said second spiral seal is fitted in said second spiral groove.

3. The scroll type compressor as set forth in claim 2, wherein each of said spiral seals is formed of a synthetic resin containing an abrasive resistant material.

4. The scroll type compressor as set forth in claim 3, wherein said abrasive resistant material is selected from the group consisting of carbon fiber and glass fiber.

5. The scroll type compressor as set forth in claim 3, wherein said movable scroll is in sliding contact with said housing and orbits about said axis of said drive shaft to slide on said housing.

6. The scroll type compressor as set forth in claim 5, wherein said abrasive resistant material is selected from the group consisting of carbon fiber and glass fiber.

7. The scroll type compressor as set forth in claim 3, further comprising a ring interposed between said movable scroll and said housing to receive said reaction force from said movable scroll and transfer said reactive force to said housing.

8. The scroll type compressor as set forth in claim 7, wherein said abrasive resistant material is selected from the group consisting of carbon fiber and glass fiber.

9. The scroll type compressor as set forth in claim 2, wherein said movable scroll is in sliding contact with said housing and orbits about said axis of said shaft to slide on said housing.

10. The scroll type compressor as set forth in claim 2, further comprising a ring interposed between said movable scroll and said housing to receive said reaction force from said movable scroll and transfer said reaction force to said housing.

11. The scroll type compressor as set forth in claim 10, wherein said movable scroll is in sliding contact with said housing and orbits about said axis of said shaft to slide on said housing.

12. The scroll type compressor as set forth in claim 1, wherein each of said spiral seals is formed of a synthetic resin containing an abrasive resistant material.

13. The scroll type compressor as set forth in claim 12, wherein said abrasive resistant material is selected from the group consisting of carbon fiber and glass fiber.

14. The scroll type compressor as set forth in claim 1, further comprising a ring interposed between said movable scroll and said housing to receive said reaction force from said movable scroll and transfer said reaction force to said housing.

15. The scroll type compressor as set forth in claim 1, wherein said first formula applies to an outer peripheral portion of said first spiral seal.

16. The scroll type compressor as set forth in claim 1, wherein said movable scroll is in sliding contact with said housing and orbits about said axis of said drive shaft to slide on said housing.

17. The scroll type compressor as set forth in claim 1, wherein said second spiral seal has a height ($\omega 2$) defined by a second formula:

$$\alpha 2>\omega 2>\alpha 2\{1-(\lambda 2/\kappa 2)\}$$

where $\alpha 2$ represents the clearance defined between said fixed spiral end face and said movable end plate, where $\lambda 2$ is the radius of an arc locus of the rotational movement of a tip of said second spiral seal about a second point that supports said movable scroll when said movable scroll is inclined relative to said shaft, and where $\kappa 2$ is the radius of an arc locus of the rotational movement of a tip of said fixed spiral element about said second point.

18. The scroll type compressor as set forth in claim 17, wherein said second formula applies to an outer peripheral portion of said second spiral seal.

19. The scroll type compressor as set forth in claim 17, wherein said movable spiral end face has a first spiral groove and said fixed spiral end face has a second spiral groove, and wherein said first spiral seal is fitted in said first spiral groove and said second spiral seal is fitted in said second spiral groove.

20. The scroll type compressor as set forth in claim 19, wherein each of said spiral seals is formed of a synthetic resin containing an abrasive resistant material.

21. The scroll type compressor as set forth in claim 20, wherein said abrasive resistant material is selected from the group consisting of carbon fiber and glass fiber.

22. The scroll type compressor as set forth in claim 20, further comprising a ring interposed between said movable scroll and said housing to receive said reaction force from said movable scroll and transfer said reaction force to said housing.

23. The scroll type compressor as set forth in claim 22, wherein said abrasive resistant material is selected from the group consisting of carbon fiber and glass fiber.

24. The scroll type compressor as set forth in claim 19, wherein said movable scroll is in sliding contact with said housing and orbits about said axis of said shaft to slide on said housing.

25. The scroll type compressor as set forth in claim 24, wherein each of said spiral seals is formed of a synthetic resin containing an abrasive resistant material.

26. The scroll type compressor as set forth in claim 25, wherein said abrasive resistant material is selected from the group consisting of carbon fiber and glass fiber.

27. The scroll type compressor as set forth in claim 26, further comprising a ring interposed between said movable scroll and said housing to receive said reaction force from said movable scroll and transfer said reaction force to said housing.

28. The scroll type compressor as set forth in claim 27, wherein said first formula applies to an outer peripheral portion of said first spiral seal.

29. The scroll type compressor as set forth in claim 28, wherein said second formula applies to an outer peripheral portion of said second spiral seal.

30. A scroll type compressor having a movable scroll mounted for orbital motion about an axis of a drive shaft and a fixed scroll located opposite said movable scroll in a housing, said movable scroll having a movable end plate and a movable spiral element, said fixed scroll having a fixed end plate and a fixed spiral element, wherein said movable scroll is permitted to incline due to clearance between the scrolls based on an assembling tolerance, said movable spiral element and said fixed spiral element defining a plurality of pockets therebetween with the volume of each pocket varying with the orbital movement of the movable scroll to compress gas causing a compressive reaction force on the housing, said compressor further comprising:

where said spiral elements each have an end face, and said end faces of said moveable and spiral elements have, respectively, first and second spiral grooves;

a first spiral seal fitted in said first spiral groove and arranged to contact said fixed end plate;

a second spiral seal fitted in said second spiral groove and arranged to contact said movable end plate;

at least one of said spiral seals extending from its associated end face by an amount determined for keeping an outer peripheral surface of the spiral element from which said at least one seal extends and an adjacent end plate of the opposite scroll free from contact with each other when said movable scroll is in an inclining position based on said assembling tolerance;

a ring interposed between said movable scroll and said housing to receive said compressive reactive force from said movable scroll and transfer said reactive force to said housing;

said first seal having a height ($\omega 1$) which is defined by a first formula:

$$\alpha 1>\omega 1>\alpha 1\{1-(\lambda 1/\kappa 1)\}$$

where $\alpha 1$ represents the clearance defined between said end face of said movable spiral element and said fixed end plate, where $\lambda 2$ represents the radius of an arc locus depicted by the rotational movement of a tip of said first seal about a first point supporting the movable scroll when the movable scroll is inclined due to the assembling tolerance, and where $\kappa 1$ represents the radius of an arc locus generated by the rotational movement of a tip of the movable spiral element about said first point, and wherein said first formula applies to an outer peripheral portion of said first seal; and said second seal having a height $\omega 2$ defined by a second formula:

$$\alpha 2>\omega 2>\alpha 2\{1-(\lambda 2/\kappa 2)\}$$

where $\alpha 2$ represents the clearance defined between said end face of said fixed spiral element and said movable end plate, where $\lambda 2$ represents the radius of an arc locus depicted by the rotational movement of a tip of said second seal about a second point supporting the movable scroll when the movable scroll is inclined due to the assembling tolerance, and where $\kappa 2$ represents the radius of an arc locus generated by the rotational movement of a tip of the fixed spiral element about said second point, and wherein said second formula applies to an outer peripheral portion of said second seal.

* * * * *

UNITED STATES PATENT AND TRADEMARK OFFICE

CERTIFICATE OF CORRECTION

PATENT NO. : 5,545,020

DATED : August 13, 1996

INVENTOR(S) : Fukanuma et al

It is certified that error appears in the above-indentified patent and that said Letters Patent is hereby corrected as shown below:

Column 1, line 31, "ill" should read --111--.

Column 8, line 14, "reactive" should read --reaction--.

Signed and Sealed this

Nineteenth Day of August, 1997

*Attest:*

Bruce Lehman

BRUCE LEHMAN

*Attesting Officer*

*Commissioner of Patents and Trademarks*